US010463071B2

(12) United States Patent
Rushforth et al.

(10) Patent No.: US 10,463,071 B2
(45) Date of Patent: Nov. 5, 2019

(54) CONTAINER

(71) Applicant: BRITISH AMERICAN TOBACCO (INVESTMENTS) LIMITED, London (GB)

(72) Inventors: David Rushforth, London (GB); Paul Gibson, London (GB); Eva Sommarstrom, London (GB)

(73) Assignee: British American Tobacco (Investments) Limited, London (GB)

( * ) Notice: Subject to any disclaimer, the term of this patent is extended or adjusted under 35 U.S.C. 154(b) by 432 days.

(21) Appl. No.: 14/785,568

(22) PCT Filed: Apr. 15, 2014

(86) PCT No.: PCT/GB2014/051168
§ 371 (c)(1),
(2) Date: Oct. 19, 2015

(87) PCT Pub. No.: WO2014/170653
PCT Pub. Date: Oct. 23, 2014

(65) Prior Publication Data

US 2016/0073681 A1 Mar. 17, 2016

(30) Foreign Application Priority Data

Apr. 18, 2013 (GB) ..... 1307028.9

(51) Int. Cl.
*A24B 15/30* (2006.01)
*B65D 81/20* (2006.01)
(Continued)

(52) U.S. Cl.
CPC ..... *A24B 15/302* (2013.01); *A24B 15/301* (2013.01); *A24B 15/303* (2013.01);
(Continued)

(58) Field of Classification Search
CPC ..... A24B 15/302; A24B 15/301
(Continued)

(56) References Cited

U.S. PATENT DOCUMENTS 126,340 A * 4/1872 Steele ..... A24F 25/02 312/31.1
1,863,511 A * 6/1932 Roscoe ..... A01M 1/2055 223/86

(Continued)

FOREIGN PATENT DOCUMENTS

GB 2467971 A 8/2010
JP 2011000004 A 1/2011

(Continued)

OTHER PUBLICATIONS

Botanical, Definition of Botanical by Merriam-Webster, https://www.merriam-webster.com/dictionary/botanical.*

(Continued)

*Primary Examiner* — Eric Yaary
*Assistant Examiner* — Russell E Sparks
(74) *Attorney, Agent, or Firm* — McKee, Voorhees & Sease, PLC

(57) ABSTRACT

A container for a consumable recipient product. The container also contains a non-consumable donor product carrier which contains a donor product which emits a substance to impart a characteristic to the recipient product in the container. The donor product carrier includes a barrier layer, disposed between the donor product and the recipient product, through which the substance can travel.

12 Claims, 1 Drawing Sheet

(51) Int. Cl.
*A24F 23/00* (2006.01)
*A24F 25/00* (2006.01)
*B65D 81/22* (2006.01)

(52) U.S. Cl.
CPC ..... *A24F 23/00* (2013.01); *A24F 25/00* (2013.01); *B65D 81/2069* (2013.01); *B65D 81/2076* (2013.01); *B65D 81/22* (2013.01)

(58) Field of Classification Search
USPC ..... 131/310
See application file for complete search history.

(56) References Cited

U.S. PATENT DOCUMENTS

| | | | | |
|---|---|---|---|---|
| 1,935,840 | A * | 11/1933 | Fitzgerald | A24F 23/02 206/236 |
| 4,804,101 | A * | 2/1989 | Heath | A24F 23/00 206/236 |
| 2005/0173272 | A1 | 8/2005 | Lemmons, IV | |
| 2007/0012328 | A1 | 1/2007 | Winterson et al. | |
| 2007/0104902 | A1* | 5/2007 | Popplewell | B32B 27/18 428/34.2 |
| 2007/0261707 | A1 | 11/2007 | Winterson et al. | |
| 2008/0317911 | A1 | 12/2008 | Schleef et al. | |
| 2009/0025741 | A1 | 1/2009 | Crawford et al. | |
| 2010/0163062 | A1* | 7/2010 | Atchley | A24B 13/00 131/119 |
| 2010/0218779 | A1 | 9/2010 | Zhuang et al. | |
| 2010/0300464 | A1 | 12/2010 | Gee et al. | |
| 2011/0083677 | A1* | 4/2011 | Carroll | A24F 23/00 131/275 |
| 2011/0180087 | A1 | 7/2011 | Gee et al. | |
| 2011/0253562 | A1* | 10/2011 | Machado | B65D 81/28 206/213.1 |
| 2012/0073589 | A1 | 3/2012 | Kawata et al. | |
| 2012/0085360 | A1 | 4/2012 | Kawata et al. | |

FOREIGN PATENT DOCUMENTS

| | | | | |
|---|---|---|---|---|
| WO | 2007144687 | A1 | 12/2007 | |
| WO | 2008148702 | A1 | 12/2008 | |
| WO | 2008154520 | A1 | 12/2008 | |
| WO | 2010066510 | A1 | 6/2010 | |
| WO | 2011061130 | A1 | 5/2011 | |
| WO | WO-2012085499 | A1 * | 6/2012 | A24C 5/60 |
| WO | 2012131989 | A1 | 10/2012 | |

OTHER PUBLICATIONS

Moisture, Defintion of Moisture by Merriam-Webster, https://www.merriam-webster.com/dictionary/moisture.*

Leaf, Defintion of Leaf by Merriam-Webster, https://www.merriann-webster.com/dictionary/leaf.*

European Patent Office, "Written Opinion of the International Searching Authority", issued in connection to International Application No. PCT/GB2014/051168, dated Oct. 18, 2015, 6 pages, dated Oct. 18, 2015.

* cited by examiner

CONTAINER

CROSS-REFERENCE TO RELATED APPLICATIONS

This application is the National Stage of International Application No. PCT/GB2014/051168, filed Apr. 15, 2014, which claims priority to and benefit of Great Britain Patent Application No. 1307028.9, filed Apr. 18, 2013, all of which are herein incorporated by reference in their entirety for all purposes.

FIELD

This invention relates to a container, specifically but not exclusively to a container for a snus smokeless tobacco product.

BACKGROUND

Snus tobacco may be sold either in loose form or in portions disposed in permeable bags and is packaged in portable containers having a re-closable lid to maintain the moisture of the snus during transport, storage and display of the product. Snus is typically consumed by placing it under the upper lip for an extended period of time.

SUMMARY

In accordance with embodiments of the invention, there is provided a container for a consumable recipient product, wherein said container also contains a non-consumable donor product carrier which contains a donor product configured to emit a substance to impart a characteristic to a recipient product in the container, the donor product carrier comprising a barrier layer, disposed between the donor product and the recipient product, through which the substance can travel.

The barrier layer may permeable or semi-permeable.

The non-consumable donor product carrier may comprise a pouch which includes said barrier layer, said pouch containing said donor product.

The non-consumable donor product carrier may be disposed in a chamber of said container, said chamber also containing said consumable recipient product.

The container may further comprise a secondary chamber and said non-consumable donor product carrier is disposed in said secondary chamber prior to first opening of the container.

The non-consumable donor product carrier may comprise a removable sealing wrap:

The non-consumable donor product carrier may be visually different to the consumable recipient products.

The container may contain one or more recipient products.

The container ay contain a Plurality of donor product carriers.

The recipient product may be a smokeless tobacco product.

The recipient product may be a snus tobacco product.

The substance emitted by the donor product may be a sensate substance to impart an organoleptic characteristic to a recipient product in the container.

The substance emitted by the donor product may be a moisturising substance to provide moisture to a recipient product in the container.

In accordance with embodiments of the invention, there is also provided a method of providing a consumable recipient product with a characteristic, comprising the step of placing a non-consumable donor product carrier within a container holding said recipient product, wherein said non-consumable donor product carrier contains a donor product which emits a substance that travels through a barrier layer of the donor product carrier to provide said recipient product with a characteristic.

The method may include the step of providing the non-consumable donor product carrier with a removable sealing wrap prior to placing said non-consumable, donor product carrier within said container.

In accordance with embodiments of the invention, there is provided a non-consumable donor product carrier comprising a pouch containing a donor product which emits a substance to impart a characteristic on a proximate recipient product, said pouch comprising a barrier layer through which the substance can travel. The pouch may comprise perforations or be porous to allow said sensate substance to exit said pouch.

BRIEF DESCRIPTION OF THE DRAWINGS

Embodiments of the invention will now be described, by way of example only. With reference to the accompanying drawings, in which.

DESCRIPTION

Figure 1:
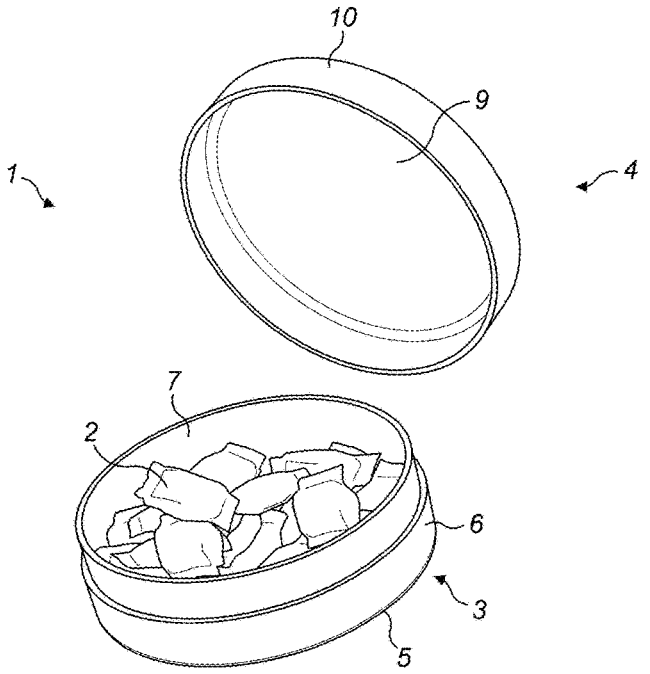
FIG. 1 shows a container for snus tobacco pouches having a main body and a removable lid.

FIG. 1 shows an example of a container it for snus tobacco pouches 2 which comprises a main body 3 and a removable lid 4. The example shown in FIG. 1 is a round container which is pocket-sized for the convenience of the consumer, although it will be appreciated that other shapes and sizes are also possible and fall within the scope of the invention as defined in the claims.

The main body 3 of the container 1 shown in Figure it comprises a planar bottom wall 5 and a cylindrical side wall 6 which extends perpendicularly to the bottom wall 5 to define a chamber 7 which is closed by the removable lid 4. The lid 4 also comprises a planar top wall 9 with a cylindrical side wall 10 that extends perpendicularly to the top wall 9. The chamber 7 is for storing products 2 such as snus tobacco products.

As shown in FIG. 1, the lid 4 of the container 1 attaches to the main body 3 by means of a push fit—the tolerance between the lid 4 and the main body 3 is a push-fit, so that the consumer must push the lid 4 firmly onto the main body 3 to close the container 1. This ensures that the container 1 is adequately sealed from the outside environment while still being removable to allow the consumer to open the container and retrieve the products 2. By sealing the container, it is ensured that the product 2 within the chamber 7 remains fresh from the time of packaging to the time of consumption. It will be appreciated that the lid 4 may alternatively be attachable to the main body 3 of the container 1 in other ways, for example, the lid and main body may be provided with so screw elements that engage with each other so that the lid is screwed onto the main body. Any other suitable method of allowing the lid 4 to be attachable to the main body 3 may also be used.

It is noted that in some embodiments, the main body 3 and lid 4 of the container shown. in FIG. 1 may hermetically seal the chamber 7 from the atmosphere outside the container 1, It is important that the product 2 within the container is kept fresh from the time of packaging to the time of consumption. Moreover, any flavourant or other organoleptic characteristic provided to the product prior to packaging will gradually degrade over time. Therefore, it may be desirable to ensure those characteristics are maintained while the packaged product is stored, transported and displayed for sale. It may also be desirable to be able to refresh those characteristics once the container has been purchased by a consumer.

In the example shown in FIG. 1, the chamber 7 within the container 1, as defined between the main body 3 and the lid 4, is for containing a smokeless snus tobacco product which may be provided in pouches 2 for the consumer's convenience. Snus pouches are permeable bags which contain a snus tobacco product and are placed in a user's mouth where saliva penetrates the bag, releasing flavour and other chemicals. However, it will be appreciated that the container 1 of the invention may instead be used for other products, such as loose snus tobacco, loose rolling tobacco or other tobacco products, smokeless or otherwise. Also, non-tobacco products, such as inert materials supplied with nicotine, or plant matter other than tobacco, could be used. The smokeless snus tobacco product (or alternative contained in the primary chamber 7 may be known as the recipient product.

Figure 2:
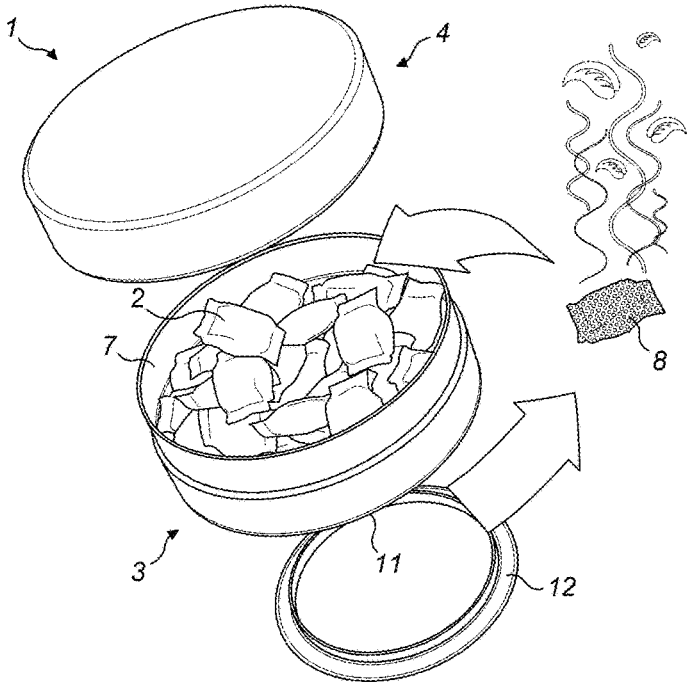
FIG. 2 shows an example of a container for snus tobacco pouches having a secondary chamber.

As shown in FIG. 2, to provide an organoleptic characteristic to the product 2 within the container between the time of packaging and the time the container is opened, a donor pouch 8 containing a donor product is placed in the chamber 7 with the recipient products 2 and the container 1 is closed to seal the chamber 7. The donor pouch 8 may be a permeable, semi-permeable, porous or perforated material containing a donor product. The donor product in the donor pouch 8 will emit a sensate substance that is transferred to the recipient products 2 in the chamber 7 to impart an organoleptic characteristic thereon. A sensate substance will impart a characteristic on the recipient products that can be perceived by the senses. In particular, the sensate substance may impart a flavour and/or an aroma to the recipient products. Although only a single donor pouch 8 is described here, it will be appreciated that a plurality of donor pouches could also be used.

In the case that the donor pouch 8 is a semi-permeable material, the sensate substance may travel from the donor product to the recipient products 2 but other substances cannot travel from the recipient products 2 to the donor product, Advantageously, this helps reduce loss of the donor product or a change in the characteristics of the donor product caused by substances that may be emitted by the recipient products 2.

The donor pouch 8 may be placed in the chamber 7 during packaging of the recipient products 2. Therefore, the donor pouch 8 is disposed in the chamber 7 with the recipient products 2 during storage, transport and sales display and possibly also after first opening, if the consumer does not remove the donor pouch 8 from the chamber. In this way, the desired organoleptic characteristic of the recipient products 2 is maintained and the consumer is presented with a fresh product on first opening of the container and by leaving the donor pouch 8 in the chamber 7 the consumer can ensure that further products are fresh when the container is opened on subsequent occasions. That is, all the products 2 have the desired flavour and/or aroma characteristics when they are consumed.

In an alternative example, the donor pouch 8 may be provided to the consumer in a sealed wrapper, which the consumer is able to open to retrieve the donor pouch 8. The sealed wrapper prevents release of the sensate substance being emitted from the donor product in the donor pouch 8. Once the sealed wrapper has been removed the consumer is able to place the donor pouch 8 in the chamber 7 of the container 1 with the recipient products 2 so that the sensate substance is transferred to the recipient products 2 to impart an organoleptic characteristic thereon.

During packaging, the sealed donor pouch 8 may be placed within the chamber 7 with the recipient products 2. Alternatively, as shown in FIG. 2, the sealed donor pouch 8 may be placed within a secondary chamber 11 of the container which does not contain recipient products and is closed by a secondary lid 12, Alternatively, the sealed donor pouch 8 may be retailed separately to the container 1 and product 2 itself to allow a user to purchase a donor pouch 8 based on a desired organoleptic characteristic of the recipient product 2.

By providing the donor pouch 8 in a sealed wrapper the consumer can elect whether or not to impart the organoleptic characteristic on the recipient products 2. Moreover, the consumer can choose when to open the wrapper and release the donor pouch 8 to begin the transfer of the sensate substance to refresh the products. Therefore, the recipient products 2 can be refreshed at a time after first opening of the container. For example, if the products 2 were fresh enough for the consumer on first opening, the consumer may wish to wait until the flavour and/or aroma of the products began to degrade before opening the wrapper and refreshing the products.

The donor product within the donor pouch 8 may comprise aromatic botanicals and/or other flavour/aroma ingredients. By placing the donor pouch 8 within the chamber 7, with the recipient products 2, the volatile flavour/aroma components from the donor product may homogenize with the recipient product during storage, transport and/or sales display so that the consumer is presented with a product freshly provided with the organoleptic characteristic. Alternatively, the consumer themselves may activate the process of homogenization of aroma/flavour volatiles between the donor product and the recipient product by removing the sealing wrapper once the container has been purchased, as previously described. Therefore, the donor pouch 8 provides the organoleptic characteristics to the recipient products 2 once the container has been purchased and opened, giving the consumer a fresh product.

Furthermore, in another example of the invention, if the container 1 comprises a secondary chamber 11 as shown in FIG. 2, the donor pouch 8 may be stored in the secondary chamber it and individual products 2 may be moved to the secondary chamber 11 by the consumer to be charged with the sensate substance and organoleptic characteristic prior to consumption. That is, for example, a consumer may move an individual snus pouch 2 into the secondary chamber 11 where the donor pouch 8 is disposed in order to provide a desired flavour or aroma to that snus pouch prior to consumption.

These fresh characteristics, imparted to the recipient product post-packaging, are preferable because the intensity and affect of the donor product has not diminished as severely during storage, transport and shelf-life and after initial opening of the container. Moreover, the user-activated donor pouches allow a user to choose when they want the organoleptic characteristics to be imparted to the products and even, by selecting different donor pouches, what characteristics they desire.

The material of the donor product may be. different to that of the recipient products 2, or it may be the same. Examples of possible donor products that may be used to impart a characteristic on the product may be organic sensate substances such as herbs or plants, for example tobacco, eucalyptus or mint leaves. These organic substances may be treated to reduce the overall size and/or increase the intensity of the substance they emit, They may also be treated to release moisture and/or oils that carry the sensate substance to the product.

It will be appreciated that the donor product may be provided in a donor product carrier that is not a pouch, as described with reference to FIG. 2. The donor product carrier may be any kind of container that holds a donor product and provides a permeable or semi-permeable barrier layer between the donor product and the recipient product. The substance emitted by the donor product is able to travel from the donor product and through the barrier layer and to impart a characteristic on the recipient products in the container. The donor product carrier may contain a donor substance that emits a sensate substance, for example a botanical substance. Alternatively, the donor product carrier may be provided with a sensate substance by means of sorption (adsorption or absorption), infusion, impregnation, coating or any other means of providing a donor product carrier with a sensate substance.

For example, the donor product carrier may be a polymer foam which is formed into the required shape and then exposed to a sensate substance which is absorbed by the foam. The sensate substance is retained and gradually released over time. The rate of release may be accelerated by warming the material.

Another example of a donor product carrier may be a material comprised of cellulose acetate fibres which absorb a sensate substance.

Another example of a donor product carrier may be a botanical, absorbent material such as a wood material. Wood is naturally absorbent and any absorbed sensate substance would be gradually released. The wood may be a natural or processed wood. Another suitable botanical, absorbent material could he a tobacco material. Of course, the botanical, absorbent material such as the wood or tobacco may itself contribute to the sensate substance.

The sensate substance may be a volatile substance, such as an aromatic botanical substance, In this example, when the sensate substance is released or emitted from the donor product carrier in the chamber of the container, the sensate substance evaporates and permeates the chamber. When the evaporated sensate substance encounters a recipient product 2 it will impart on that product an organoleptic characteristic.

Alternatively, the sensate substance may be a liquid which is gradually released from the donor product carrier and is transferred to the products by contact. The liquid may be an oil or a solution which carries a substance which, when transferred to the recipient product, imparts an organoleptic characteristic to that product.

The sensate substance may provide a flavour to the recipient products 2, As used herein, the terms "sensate substance" and "flavour" refer to materials which, where local regulations permit, may be used to create a desired taste or aroma in a product for adult consumers. They may include extracts (e.g., eucalyptus, licorice, hydrangea, Japanese white bark magnolia leaf, chamomile, fenugreek, clove, menthol, Japanese mint, aniseed, cinnamon, herb, wintergreen, cherry, berry, peach, apple, Drambuie (distilled alcoholic liqueur having a Scotch Whiskey base), bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

Alternatively, the organoleptic characteristic may be an aroma, for example a menthol scent or other. A mentholated sensate substance may also create a cooling sensation when the infused product 2 is consumed or used, as well as providing flavour and/or aroma. It will be appreciated that any combination of organoleptic characteristics may be provided by the sensate substance which may also act to provide an aroma to the air in the chamber, such that a consumer can smell the sensate substance on opening the container.

The donor pouch 8 containing the donor product, unlike the recipient products 2, is not for consumption. To make this plainly clear to the consumer the donor pouch 8 may be visually different to the recipient products 2. For example, the donor pouch 8 may be a different colour, for example bright red, or it may comprise a written warning, for example 'not for consumption'. Alternatively, the donor product carrier 8 may haven different size and/or shape than the recipient products 2 so that a user can easily identify the donor product carrier 8. In this ease, the donor pouch 8 is provided only for transferring a sensate substance from the donor product within the donor pouch 8 to the recipient products 2 within the container.

In the example shown in FIG. 2, the donor pouch 8 contains a donor product which is will emit a sensate substance which is able to penetrate the sleeve material of the donor pouch 8. The sleeve material of the donor pouch 8 should be permeable to the sensate substance emitted by the donor product. It may also prevent the donor product from leaving the donor pouch 8. For example, the sleeve material of the donor pouch could be a semi-permeable material. Alternatively, the donor pouch 8 may comprise perforations through which the sensate substance can travel but these perforations should be too small for the donor product to pass through.

It is noted that, in some embodiments, the chamber 7 may be divided into any number of sub-chambers for storage of the recipient products 2 and donor pouches 8. This would allow different combinations of recipient products 2 and donor pouches 8 to be contained in each sub-chamber, improving the choice for the consumer.

In the examples described above with reference to FIGS. 1 and 2 the donor pouch emits a sensate substance to impart an organoleptic characteristic to the recipient products in the container 1. However, it will be appreciated that the donor pouch may alternatively emit any other substance which will impart any other characteristic to the recipient products.

For example, the donor pouch may emit a moisturising substance to provide the recipient products with moisture.

The moisturising substance emitted by the donor pouch may be any substance that provides the recipient products with moisture, for example a water-based solution or any other substance. Advantageously, moisture provided by the donor pouch in this example will prevent the recipient products becoming dry during storage in the container prior to purchase or after purchase. The donor pouch provided with a moisturising substance may be placed in the container during packaging so that the consumer is presented with a fresh product on first opening. Alternatively, the consumer could place the donor pouch provided with a moisturising substance in the container to impart moisture on the recipient products after first opening to prevent the recipient products from drying out after first opening of the container.

It will be appreciated that the donor pouch may emit both a sensate substance and a moisturising substance, which may be a single substance or a combination of two or more substances. For example, the substance emitted may be a sensate substance which is water-based, or carried by a water-based substance, and therefore capable of providing both an organoleptic characteristic and a moisturising characteristic.

It will therefore be appreciated that the substance emitted by donor pouch may impart to the recipient product any characteristic which may be desirable, for example the substance may impart a characteristic of flavour, aroma, moisture content, quality or longevity or any other beneficial characteristic.

It should also be clear that, in embodiments, any number of recipient products 2 and donor pouches 8 may be used.

In order to address various issues and advance the art, the entirety of this disclosure shows by way of illustration various embodiments in which the claimed invention(s) may be practiced and provide for a superior container for tobacco products. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. In combination, a container and a product, comprising: the container comprising a chamber;

a consumable recipient product in the chamber of the container, the recipient product being a smokeless tobacco product; and a non-consumable donor product carrier in the chamber comprising a donor product emitting a substance to impart an organoleptic characteristic to the recipient product in the container when the donor product carrier is placed in the chamber with the recipient product;

said donor product comprising a botanical substance comprising an organic sensate plant substance at least partially including herb or plant matter, and said donor product carrier comprising a barrier layer containing the donor product and disposed between the donor product and the recipient product, through which the substance can travel.

2. The container of claim 1, wherein the barrier layer is permeable or semi-permeable.

3. The container of claim 1, wherein the non-consumable donor product carrier comprises a pouch which includes said barrier layer, said pouch containing said donor product.

4. The container of claim 1, wherein the non-consumable donor product carrier is disposed in the chamber of said container, said chamber also containing said consumable recipient product.

5. The container of claim 1, wherein the container further comprises a secondary chamber and said non-consumable donor product carrier is disposed in said secondary chamber prior to first opening of the container.

6. The container of claim 1, wherein the non-consumable donor product carrier comprises a removable sealing wrap.

7. The container of claim 1, wherein the non-consumable donor product carrier is visually different to the consumable recipient products.

8. The container of claim 1, wherein the container contains more than one recipient product.

9. The container of claim 1, wherein the container contains a plurality of donor product carriers.

10. The container of claim 1, wherein the recipient product is a snus tobacco product.

11. The container of claim 1, wherein the substance emitted by the donor product is a sensate substance to impart the organoleptic characteristic to the recipient product in the container.

12. The container of claim 1, wherein the substance emitted by the donor product is a moisturising substance to provide moisture to the recipient product in the container.

* * * * *